US007868235B2

(12) United States Patent
Medas

(10) Patent No.: US 7,868,235 B2
(45) Date of Patent: Jan. 11, 2011

(54) BRIDGE SYSTEM FOR IMPROVED ACOUSTIC COUPLING IN STRINGED INSTRUMENTS

(75) Inventor: Brian Medas, Midlothian, VA (US)

(73) Assignee: Medas Instruments, Inc., Richmond, VA (US)

( * ) Notice: Subject to any disclaimer, the term of this patent is extended or adjusted under 35 U.S.C. 154(b) by 0 days.

(21) Appl. No.: 12/505,198

(22) Filed: Jul. 17, 2009

(65) Prior Publication Data

US 2010/0037746 A1 Feb. 18, 2010

Related U.S. Application Data

(63) Continuation-in-part of application No. 11/837,401, filed on Aug. 10, 2007, now Pat. No. 7,563,968.

(60) Provisional application No. 60/836,699, filed on Aug. 10, 2006.

(51) Int. Cl.
*G10D 3/14* (2006.01)

(52) U.S. Cl. ..... 84/298; 84/299

(58) Field of Classification Search ..... 84/298, 84/299

See application file for complete search history.

(56) References Cited

U.S. PATENT DOCUMENTS

| | | | | |
|---|---|---|---|---|
| 4,385,543 | A * | 5/1983 | Shaw et al. | 84/298 |
| 4,538,498 | A * | 9/1985 | Marten | 84/298 |
| 5,600,078 | A * | 2/1997 | Edwards | 84/307 |
| 7,563,968 | B2 * | 7/2009 | Medas | 84/298 |
| 7,638,697 | B2 * | 12/2009 | Moore | 84/298 |
| 2008/0034940 | A1 * | 2/2008 | Medas | 84/298 |
| 2010/0037746 | A1 * | 2/2010 | Medas | 84/298 |

* cited by examiner

*Primary Examiner*—Elvin G Enad
*Assistant Examiner*—Robert W Horn
(74) *Attorney, Agent, or Firm*—Greenberg Traurig LLP

(57) ABSTRACT

A bridge system for connection to the instrument body of a stringed instrument, the bridge system including at least one bridge piece configured to contact at least one string of the stringed instrument and a ramp-shaped height and tone adjustment bar between the bridge piece and the instrument body. An adjustment mechanism translates the bridge piece with respect to the height and tone adjustment bar to raise and lower the string and to provide contact between the bridge piece and the height and tone adjustment bar.

13 Claims, 8 Drawing Sheets

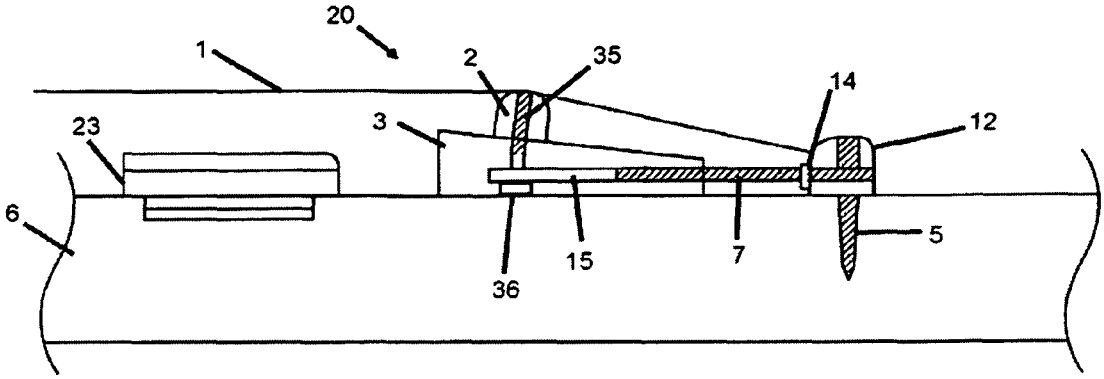
FIG. 8
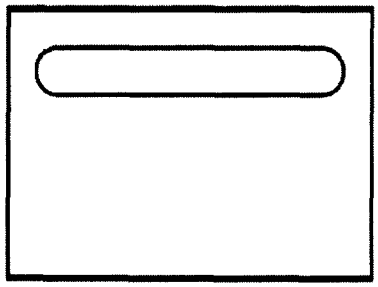
FIG. 9(a)
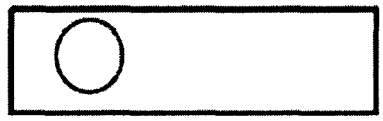
FIG. 9(c)
FIG. 9(d)
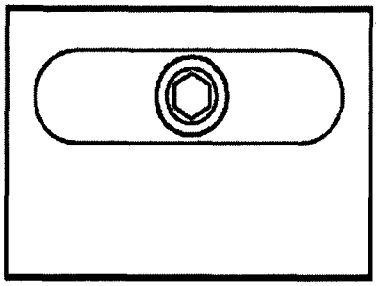
FIG. 9(b)
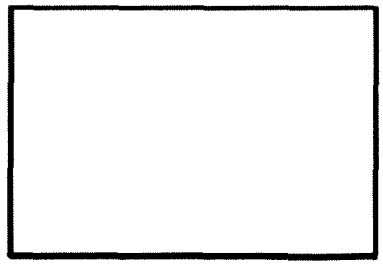

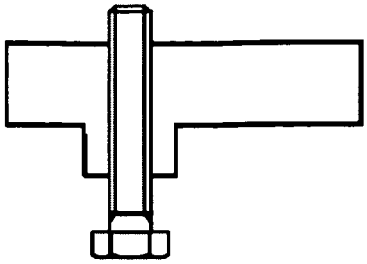
FIG. 10(a)
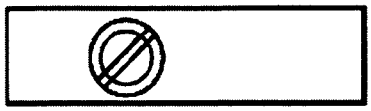
FIG. 10(b)
FIG. 11(a)
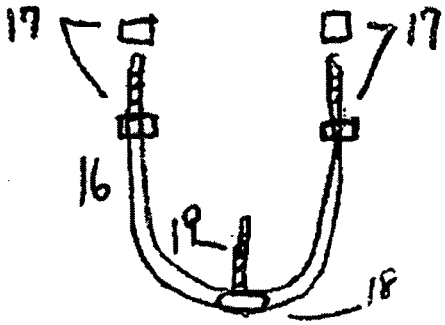
FIG. 11(b)
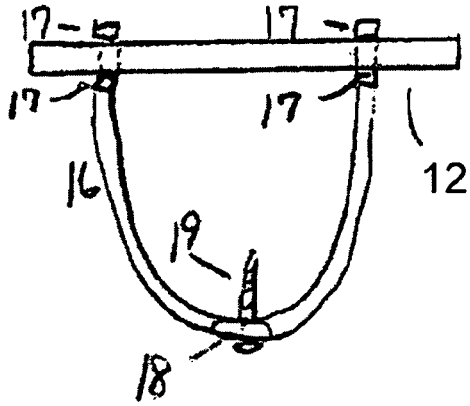
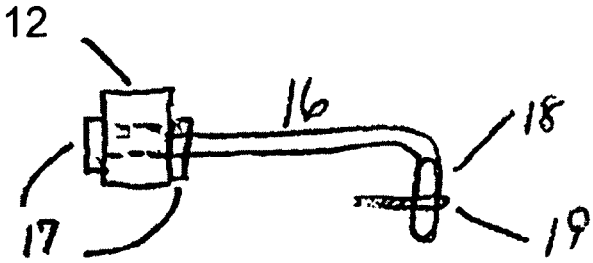
FIG. 11(c)
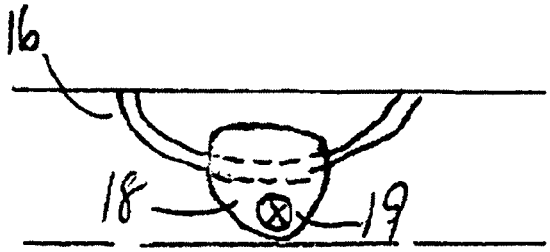
FIG. 11(d)

BRIDGE SYSTEM FOR IMPROVED ACOUSTIC COUPLING IN STRINGED INSTRUMENTS

This application is a Continuation-in-Part of U.S. patent application Ser. No. 11/837,401 filed on Aug. 10, 2007, now U.S. Pat. No. 7,563,968 the entire disclosure of which is incorporated herein by reference, which in turn claims priority from U.S. Provisional Application No. 60/836,699 filed Aug. 10, 2006.

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates in general to the field of fretted or stringed instruments, and in particular to a novel bridge system for providing improved acoustic coupling in such instruments.

BACKGROUND OF THE INVENTION

String instrument bridges have six functions to perform which are of equal importance in the overall level of quality of an instrument. These functions include the following:

1) To transfer as close to 100% as possible the vibrations of the strings to the body of the instrument.

2) To influence the tonal quality of the vibrations in a way that is generally considered aesthetically pleasing or pleasing specifically to the musician playing it.

3) To enhance or aid in the production of vibrations or notes that can be sustained for long periods of time. The term "legato" is commonly used in the directions from the composer on how to perform a piece of music. The dictionary states the meaning of legato as "in a smooth flowing manner, without breaks between notes." Throughout the ages the majority of instrumental music, no matter what the style or from what period, has been written with the intension of imitating the human voice as it is used to sing. Most string instruments are harmonic instruments. The are able to play music called chords which are notes stacked on top of one another and played at the same time. The music notation is written up and down or vertically, as it may be. When performed, however, it is to be played horizontally, along one or more lines in which the notes are to sound smooth and connected. The challenge to play legato is even more difficult in the case of the string instruments referred to as plectrum instruments, i.e. guitars, basses, banjos, mandolins for the string is plucked. With this plucking action the length of time that the note or vibration sustains is more limited than many other musical instruments so an instrument that sustains well is paramount for the plectrum string instrumental performance.

4) To adjust the string height vertically, described also as close to or away from the instrument. This is for the purpose of providing an adjustment when needed for the clearance of the string(s) from the fretboard or fingerboard located on the neck of the instrument. This string height also is adjusted as per the comfort or ease of play for the musician otherwise known as "the action."

5) The horizontal movement of the bridge or bridge pieces for the purpose of adjusting the intonation of the instrument. Intonation is the accuracy of pitch on a musical instrument.

Various thicknesses in the strings diameter dictate the length of the string and effect the placement of the bridge or bridge pieces upon which the string rests.

6) The musician makes contact with the instrument when touching the strings. To provide a solid and full "feel" and thus feedback of information in to the fingertips, hands and body and mind of the musician the bridge must works equally in concert with the strings and body of the instrument in this function. This creates an environment, which influences the instrumental musicians personal expression of the sound and music.

Stringed instruments, particularly electric and acoustic guitars, typically require a bridge on the body of the instrument to lift the strings so that an appropriate gap exists between the strings and the fretboard or fingerboard of the instrument. Bridges that are utilized on electric guitars are often adjustable in height such that this gap, or "action," can be set to provide a desired tone and/or feel when the strings are depressed onto the fretboard by the player's fingers. Such bridges typically also provide adjustment of the intonation or position of the bridge or bridge piece(s). Bridges further function to transfer the vibrations of the instrument's string(s) to the body of the instrument, thus causing resonation of the instrument body and increasing resonation of the strings.

The past several decades have seen minimal changes and improvements in the basic design of the bridge. Generally, the height of the string(s) has been adjusted using two approaches. The first is the tune-o-matic type bridge design. In this design the strings rest on an object commonly called a bridge assembly. The bridge assembly rests on two threaded poles or posts, one at each end of the bridge assembly. These poles or posts are mounted into a threaded base. The poles or posts can be raised or lowered by turning their threaded shafts, thus raising or lowering them in much the same manner as screwing a screw into or out of a piece of wood. Turning the threaded shaft to the right causes it to recede down into the threaded base, and turning the threaded shaft to the left causes it to rise up out of the threaded base.

Another version of the tune-o-matic bridge has the threaded poles or posts secured in a fixed position. Each pole or post has a threaded wheel which is free to turn. The bridge assembly sits upon these two wheels. Again a right turning of the wheel raises it up the threaded pole or post, thus causing the bridge assembly to rise with the wheel upon which it sits, and a left turning of the wheel lowers it down the treaded pole or post, thus lowering the bridge assembly along with the wheel.

Another approach to adjusting the height of the strings is used in hard-tail or fixed bridges and tremolo bridges. Both of these bridge designs typically have a bridge plate securely mounted to the instrument body and individual bridge pieces attached to a bridge body upon which the strings rest. These bridge pieces are secured to the bridge plate with an adjustment screw or bolt. The function of that screw or bolt will be described in further detail below. The bridge piece(s) typically have two threaded holes in them. These two threaded holes accept two threaded screws, sometimes called feet. As in the tune-o-matic bridge example described above, turning the threaded screw or feet to the right raises the bridge piece up and turning it to the left lowers the bridge down.

Adjustment of intonation on stringed instruments, particularly electric guitars, is typically performed by adjusting the position of the bridge piece(s) along the axis that is parallel to the strings. In most bridge designs this is done by moving individual bridge piece(s) forwards or backwards by turning a screw or bolt which is attached to the individual bridge piece. The screw or bolt is anchored to the bridge plate through a hole in the rear of the bridge plate. The bridge piece is often held in place with tension between the bridge piece and bridge plate provided by a spring wrapped around the above adjustment screw or bolt. Again the bridge piece has a threaded hole that accepts the threaded screw. As the screw is turned to the right the bridge piece moves down the string length and towards the end of the bridge plate. As the screw is turned to the left the bridge piece moves up the string length and away from the end of the bridge plate.

Transfer of the vibrations of the string to the body of the instrument is accomplished via contact of the string with the bridge or bridge pieces, which then make contact with their poles, posts, or adjustable screws or feet, which in turn make contact with the body of the instrument.

The bridge design, its materials, and amount of contact surface of those materials, are important factors in providing the musician with feedback or "feel" of the instrument. This in turn affects the ability of the musician to communicate his expression and interpretation of music written for the instrument. Prior bridge designs that use adjustment feet and adjustment studs for purposes of raising and lowering strings cause a tremendous loss of vibration transference from string to bridge to instrument body.

SUMMARY OF THE INVENTION

It is therefore an object of the invention to provide an improved bridge design for fretted and other stringed instruments. Over the years, there have been many attempts by many people to design a bridge or bridge system that would improve various functions of the bridge of a string musical instrument. These past attempts fell short of improving all the functions of the string instrument bridge.

The presently disclosed bridge system is the first bridge that performs all the functions listed in the above section to the maximum degree. This bridge achieves its success through performing a major and influential role in the overall function and purpose of a string musical instrument, as a desired goal of all musician/performers. The design of the bridge succeeds by doing many crucial functions favorably. It provides maximum transfer of the vibrations generated by the moving of the string to the body of the instrument with no loss of the vibrations, no deadening of sound, and no altering of tone in a negative way. At the same time, the bridge system performs the technical functions of adjusting string height by vertical movement up and down from the body of the instrument, achieves precise intonation positioning of the bridge piece by way of horizontal movement along the surface of the body of the instrument, and provides both of these functions in such a way that has no negative effect on the vibration transfer function and does not create any unwanted vibrations such as sympathetic vibrations, buzzes or rattles.

The presently disclosed bridge design performs these functions in an efficient, precise and accurate way. It is extremely user friendly for the technician or musician using the instrument. The parts necessary for this design are few in number and simple in design making for an affordable product that requires little maintenance. These parts, if reasonably used and cared for, will not come loose from the bridge assembly; and thus not be lost or damaged and will perform for an unheard of length of time. Ultimately, the disclosed bridge system provides a heightened level of "feel" or feedback of information for the musician/performer using the instrument with this bridge. The performer can clearly feel the interaction of the vibrations between the strings and the body of the instrument that is created with the performer's touch and movement of the string. This maximum performance of the equipment, combined with the ability for the musician to fully feel that maximum performance of the equipment, enhances the musicians ability maximize the creative process, demonstrating and communicating the interoperation of the music and expression of emotions through the instrument and its musical sounds.

The presently disclosed bridge system can be used on any string instrument. In one embodiment, the bridge system may be used on the electric bass. The size of the electric bass makes for large, easy to see parts and therefore drawings. The same principles, applications and parts would apply to any other solid body instrument. However, the size and scale may vary. Furthermore, because the bridge pieces are designed to work individually and sit directly on to the body of the instrument, the number of strings used can vary. In the case of string instruments with hollow bodies, such as but not limited to "jazz" guitars, acoustic guitars, mandolins, banjos, classical or Spanish guitars, dulcimers, and most bowed instruments; an obvious variation of equipment and installation designed for securing the bridge system to the body of such hollow instruments is implemented, as described below in detail.

In a preferred embodiment, the invention provides a bridge system for connection to the instrument body of a stringed instrument, the bridge system including at least one bridge piece configured to contact at least one string of the stringed instrument and a ramp-shaped height and tone adjustment bar between the bridge piece and the instrument body. An adjustment mechanism translates the bridge piece with respect to the height and tone adjustment bar to raise and lower the string and to provide contact between the bridge piece and the height and tone adjustment bar.

In a preferred embodiment, the height and tone adjustment bar of the present invention provides both the functions of raising and lowering the strings and conducting vibrations of the string from the bridge piece to the instrument body. This not only provides for a fuller, richer sound, but also gives the musician a solid feeling when playing the instrument.

The tone of the sound produced by the instrument may be modified by changing the material from which the height and tone adjustment bar is constructed. The materials in which the bridge plate, bridge piece(s) poles and posts are constructed, and the amount of surface of the bridge piece(s) that comes into contact with the body of the instrument, affects the volume of vibrations, the sustain of the vibrations, the clarity of the vibrations, and the tone of the vibrations transferred to the body of the instrument.

The invention in certain embodiments is provided in the form of a replacement bridge which has a form factor that facilitates its use as a replacement for one of several common stock bridges. Such embodiments are important where there is not a lot of space available on the instrument body, as in the tremolo, hard-tail, and tune-o-matic bridges.

The invention provides the musician with a bridge that functions far better than bridges of the prior art and offers a wider range of tone and sound to choose from, thus expanding their ability to express and interrupt the music written for the instrument.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

FIG. 2(*b*) shows a side view of the tone bar of the bridge system of the invention in accordance with one embodiment thereof.

FIG. 2(*c*) shows a side view of the low end of the tone bar of the bridge system of the invention in accordance with one embodiment thereof.

FIG. 2(*d*) shows a side view of the high end of the tone bar of the bridge system of the invention in accordance with one embodiment thereof.

FIG. 2(*e*) shows a bottom view of the tone bar of the bridge system of the invention in accordance with one embodiment thereof.

FIG. 2(*f*) shows a side view of the bridge piece of the bridge system of the invention in accordance with one embodiment thereof.

FIG. 2(*g*) shows a side view of the lock bolt and nut of the bridge system of the invention in accordance with one embodiment thereof.

FIG. 2(*h*) shows a rear view of the tail piece of the invention in accordance with one embodiment thereof.

FIG. 6(*b*) shows a top view illustrating a tune-o-matic style replacement bridge embodiment of a bridge system in accordance with the invention

FIG. 8 shows a side elevational view illustrating an embodiment of the bridge system, mounted on a stringed instrument.

FIG. 9(*a*) shows the top view of the slot in the height and tone adjustment bar, in accordance with one embodiment thereof.

FIG. 9(*b*) shows the bottom view of the slot in the height and tone adjustment bar, in accordance with one embodiment thereof.

FIG. 9(*c*) shows the side view of the lower-end of the height and tone adjustment bar, with the threaded hole that receives the height and tone adjustment bolt, in accordance with one embodiment thereof.

FIG. 9(*d*) shows the side view of the high-end of the height and tone adjustment bar, in accordance with one embodiment thereof.

FIG. 10(*a*) shows a side view of the bridge piece, showing its u-shaped extension and the lock down bolt and nut in place in the vertical hole found in the bridge piece, in accordance with one embodiment thereof.

FIG. 10(*b*) shows a side view of the bridge piece, showing the hole in the bridge piece receiving the lock down bolt, which passes through the slot in the height and tone adjustment bar and the lock down nut at the other end of the lock down bolt, in accordance with one embodiment thereof.

FIG. 11(*a*) shows a top view of the u-shaped or v-shaped rod assembly that secures the bridge system to the side of the body of a hollow body string instrument, in accordance with one embodiment thereof.

FIG. 11(*b*) shows a top view of the u-shaped or v-shaped rod assembly that secures the bridge system to the side of the body of a hollow body string instrument, wherein the rod is fed through the anchor-piece with lock nuts on either side of the anchor-piece, in accordance with one embodiment thereof.

FIG. 11(*c*) shows a side view of the rod assembly, in accordance with one embodiment thereof.

FIG. 11(*d*) shows a side view of the body of the instrument, illustrating the relationship of the rod, the clamp, and the clamp screw and rod assembly, in accordance with one embodiment thereof.

DETAILED DESCRIPTION OF THE PREFERRED EMBODIMENT

Reference will now be made in detail to the preferred embodiments of the present invention, examples of which are illustrated in the accompanying drawings.

Figure 1:
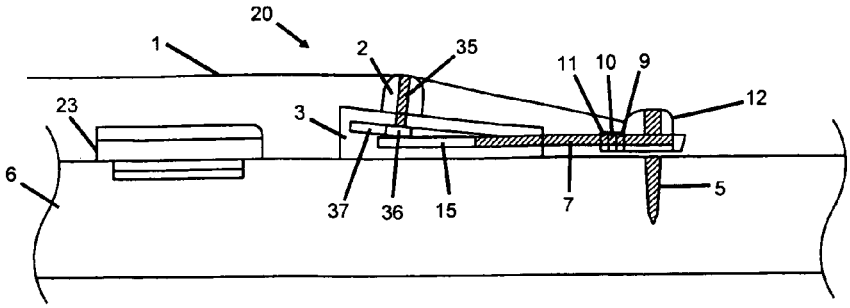
FIG. 1 shows a side elevational view illustrating an embodiment of the bridge system, mounted on a stringed instrument.
Figure 2A:
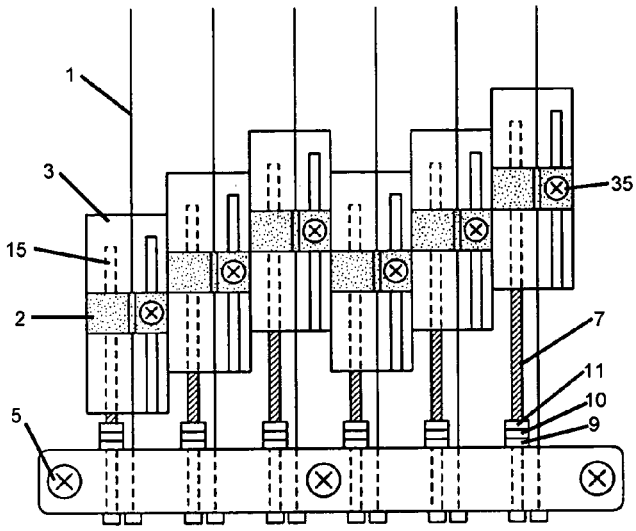
FIG. 2(*a*) shows a top view of the bridge system of the invention in accordance with one embodiment thereof.
Figure 2B:
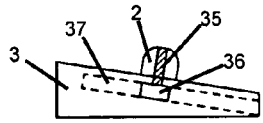
Figure 2C:
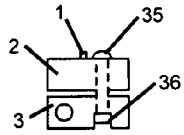
Figure 2D:
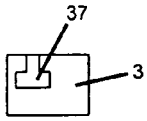
Figure 2E:
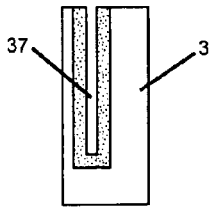
Figure 2F:
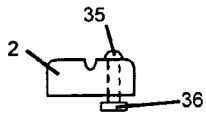
Figure 2G:
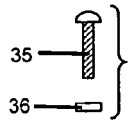
Figure 2H:
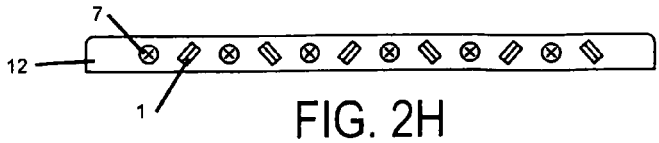

With reference to FIGS. 1 and 2(*a*), a bridge system 20 in accordance with an embodiment of the invention is mounted upon a body 6 of a stringed instrument, such as an electric or acoustic guitar. In the case of an electric guitar, the bridge system 20 may be mounted behind a pickup 23. A string or strings 1 is set into vibrating motion by the picking, plucking, hammering, or other action by a player. One end of the string(s) rests on a surface generally known as a nut, not shown. At its other end the string rests upon a bridge saddle or bridge piece(s) 2. The vibrations of the string(s) are transferred to the bridge piece(s) 2. The bridge piece(s) 2 fully rest upon height and tone adjustment piece(s)/bar(s) 3. The vibrations generated by the string(s) 1 that were transferred to the bridge piece(s) 2 are then transferred to the height and tone adjustment bar(s) 3. The height and tone adjustment bar(s) 3 have a recess 15, which may include a metal cylinder 26, for receiving a height and tone adjustment bolt 7 that is used for height and tone adjustment.

The type of material selected for the bridge piece(s) 2 and the height and tone adjustment bar(s) 3 has an affect on the volume, tone color, and sustain of the vibrations that originated from the string(s) 1. Such materials may comprise, e.g., metal, brass, lead, copper, graphite, solid surface materials such as Corian™, thermosetting plastics, animal bone, various types of wood, and polymers. The preferred material comprises of brass. The affect that these materials have on the vibrations that come into contact with them would be described as being tone colors of a bright or bell-like tone (from metal) to a dark, or warm tone (from plastic).

The sustain or duration of the vibrations that originate from the string(s) 1 is also affected by the materials used in the bridge piece(s) 2 and the height and tone adjustment bar(s) 3. Generally, the softer the material, the shorter the string vibration and duration will be.

The purpose of providing a choice of different materials is to give the musician several added options in his/her process of producing the type of sound and sustain he/she is looking for. In bridges of the prior art there is a very limited variation on materials used, and the parts typically do not have full contact with one another for various reasons, thus limiting the tone and sustain capabilities and options.

The height and tone adjustment bar(s) fully rest upon the body of the instrument. In one embodiment, a bridge base plate is not present. The vibrations that were transferred to the height and tone adjustment bar 3 are transferred directly to the body of the instrument 6. The tone bar 3 is positioned with the high end of the tone bar 3 furthest away from the tail piece 12 and the low end closest to the tail piece 12. The tail piece 12 is both the anchor housing the height and tone adjustment bolt 7, lock nuts 10 and 11, and the end of the string 1. The bridge piece 2 is adjusted or moved up and down the surface of the tone bar 3 manually. This can easily be done by first reducing approximately 50% of the downward pressure or tension of the string 1 placed on the bridge piece 2, then by gripping the bridge piece 2 with the thumb and index finger push or pull the bridge piece 2 up or down the tone bar as needed. The bridge piece 2 is kept in its proper place or track and is kept in place on the tone bar 3 with the use of a bridge bolt 35 and bridge nut 36. The bridge bolt 35 is placed, free to turn, in a hole which exists from top to bottom through the bridge piece 2. The bridge bolt also fits in to a groove 37 or T-groove that is cut in to the tone bar. The nut 36, to which the bridge piece bolt 35 is secured, travels up and down the channel or the bottom section of the T-groove cut in to the tone bar. This is illustrated in FIGS. 2(*b-g*). Nut 36 has been tapped so that it will not lose contact or separate from the bridge bolt 35.

Figure 3:
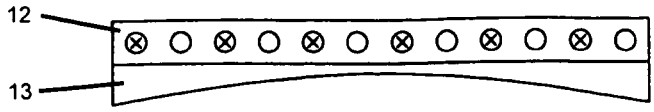
FIGS. 3 and 4 show rear views of the bridge system, along with first and second embodiments of a spacer for making contact between the base plate and an archtop instrument. The holes for the strings and the holes for the tone bar adjustment bolt are in reverse order with the tone bar hole to the left and the string hole to right of each other.
Figure 4:
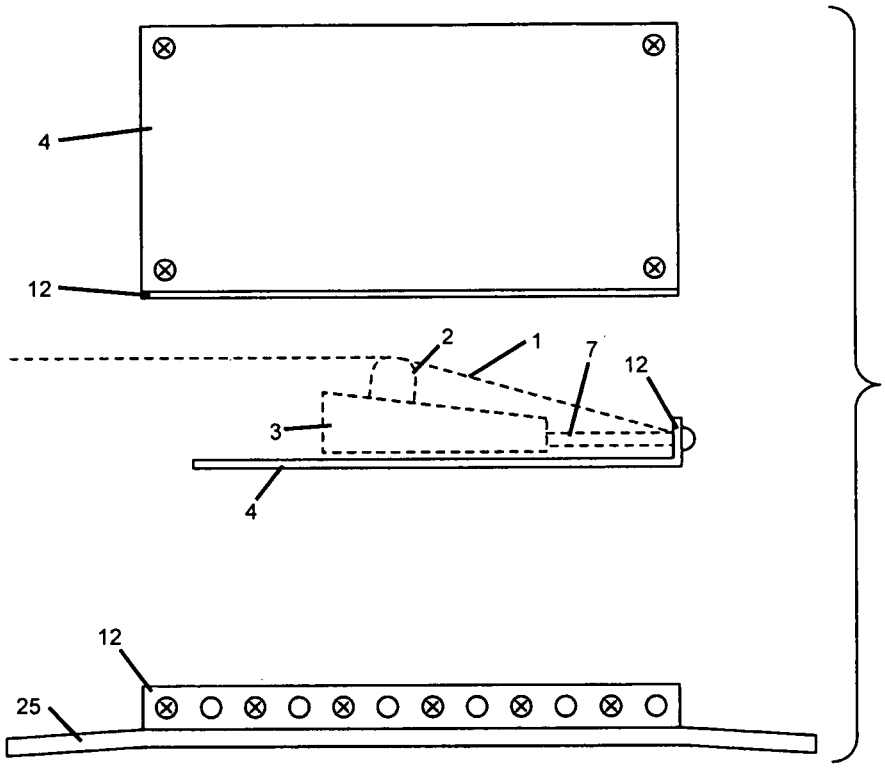

FIGS. 3 and 4 show rear views of the bridge system, along with first and second embodiments of a spacer for making contact between the base plate 4 and the curved body of an archtop instrument. For an archtop hollowbody replacement bridge, a spacer 13 may be provided. For an archtop solid body electric guitar replacement bridge, a spacer 25 may be provided. With respect to both of these parts, the string vibrations are transferred to them from the bridge base plate 4 and the type of material from which the spacers 13, 25 are made have an effect upon both the tone and sustain of the instrument.

Figure 5:
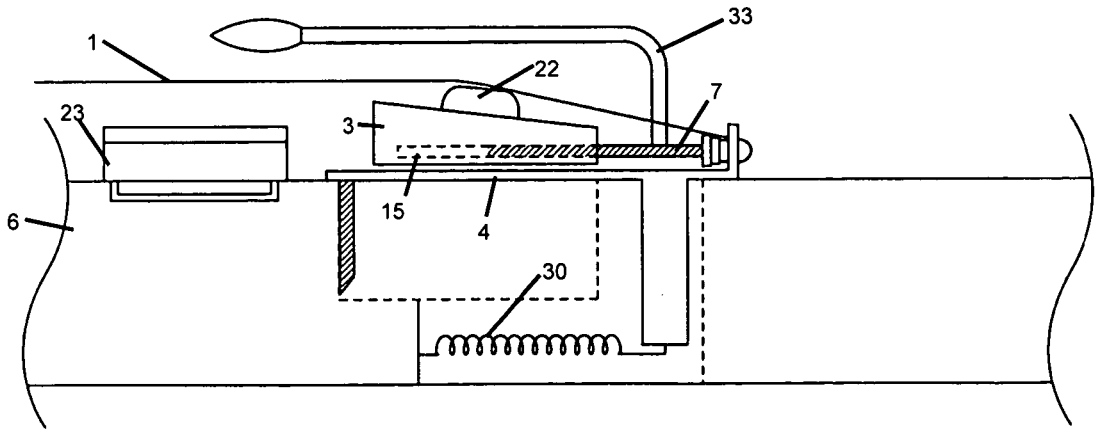
FIG. 5 shows a side elevational view illustrating a modern tremolo or fixed-bridge embodiment of a bridge system in accordance with the invention.

With continued reference to FIGS. 4 and 5, the base bridge plate 4 in certain embodiments has solid direct contact with the body 6 of the instrument, and in other embodiments, such as the archtop embodiments discussed above, has solid indirect contact with the body 6 of the instrument. Because of their positions in relationship to the bridge plate 4, and in relationship to one another, the height and tone adjustment bar 3, the bridge piece 2, and the string 1 all come into solid indirect contact with the body 6 of the instrument.

The form of the body 6 of the instrument, and the various materials from which the body 6 can be constructed, has an effect on the tone and sustain of the vibrations that originated from the string 1.

For purposes of strength and durability the bridge base plate 4 is preferably constructed from metal, but other suitable materials may be used without departing from the spirit and scope of the invention. The bridge base plate 4 provides the structure of the bridge parts assembly and allows for the movement or adjustment of the positions of the tone and height adjustment bar(s) 3 and the bridge piece(s) 2.

The shape of the height and tone adjustment bar 3 is important to its function of raising and lowering the string(s) 1. The height and tone adjustment bar 3 is higher at it's end that includes recess 15 for accepting the height and tone adjustment bolt 7. In one embodiment, it is approximately 0.25 inches high at that end, and approximately 0.08 inches high at its opposite end. This creates a slope of approximately 3 degrees. It's surface is smooth, allowing the bridge piece 2, which sits upon it, the ability to slide up and down the surface when moved or adjusted. The translational movement of the height and tone adjustment bar 3 may be used to adjust the height of the string up or down or up and away from the instrument body 6 or down towards the instrument body 6. This may be necessary to accommodate the various structures of each unique instrument so that the strings can vibrate clearly without being obstructed by any part of the instrument when the string is played open. It may also be necessary to accommodate the feel and "action" of the string, which is determined by it's height from the instrument, which becomes a factor as the musician presses down the string or stops the string on the fretboard or fingerboard.

The movement of the height and string adjustment bar 3 is accomplished by the following design. The height and tone adjustment bolt 7 is a threaded bolt fed through a hole in the bridge tailpiece 12. This bolt has a head that may be a flat head or a phillips head that will accept a tool for the purpose of turning the bolt 7. Just inside the tailpiece 12 there is a washer 9 made from a soft material such as, but not limited to, felt, rubber or plastic placed around the height and tone adjustment bolt 7. This washer 9 comes into contact with the tailpiece 12. It's purpose is to provide a cushion and limited amount of movement of the height and tone adjustment bolt 7 and to eliminate the possibility of any unwanted sympathetic vibrations from the tailpiece 12 and nut 10 touching one another, or barely touching one another, while the string is vibrating. Next on the height and tone adjustment bolt 7 are two nuts 10 and 11. Also a single lock nut can be used. These two nuts are placed on the bolt 7 close to the tailpiece 12 while still allowing the bolt 7 to freely turn.

Tightening the two nuts 10, 11 against each other causes them to lock one another in place such that they are unable to move up and down the bolt 7. This function can also be achieved and used in this design by the use of a spring encircling the bolt 7 in the area between the tailpiece 12 and the height and tone adjustment bar 3. Also a single lock nut can be used. It locks itself in place. However, in a preferred embodiment, the nut 10 against nut 11 design for it eliminates the possibility of the spring developing sympathetic vibrations during the string vibration action. The height and tone adjustment bar 3 has a threaded hole in it's side. This hole is in line with the position of the height and tone adjustment bolt 7. These threads will accept the threads of the height and tone adjustment bolt 7. In bridge models where the height and tone adjustment bar(s) 3 are made from a material other than metal this hole may have a metal cylinder 26 glued inside the hole. The metal cylinder 26 is threaded to accept the height and tone adjustment bolt 7. The bolt 7 is placed inside the threaded hole of the height and tone adjustment bar 3.

When the height and tone adjustment bolt 7 is turned the bar 3 will move. When the height and tone adjustment bolt 7 is turned to the left or counter-clockwise the height and tone adjustment bar 3 will move in the direction away from the bridge tail piece 12. Because of the slope of the top surface of the height and tone adjustment bar the bridge piece 2 which is resting upon if not moved manually will be lowered down towards the instrument body 6 thus the height of the string 1 will be lowered as well.

When the height and tone adjustment bolt 7 is turned to the right or clockwise the height and tone adjustment bar will move towards the tailpiece 12. Because of the slope of the top of the height and tone adjustment bar 3 the bridge piece which is resting upon it will be raised or moved up and away from the instrument body 6, thus the height of the string 1 will be raised as well.

The movement or adjustment of the position of the bridge piece 2 is important. Its position effects the string's 1 ability to sound in tune. It is used to adjust the instrument's intonation. In this bridge design, attention has been given to the ability to adjust the bridge piece in whatever position is necessary for proper intonation. The movement of the bridge piece 2 is accomplished by the following design. The bridge piece adjustment bolt used in other models has been eliminated in this embodiment. The bridge piece 2 is adjusted or moved up and down the surface of the tone bar 3 manually rather than with the turning of an attached bolt. This can easily be done by first reducing approximately 50% of the downward pressure created by the tension of the string 1 placed on the bridge piece 2. Then by gripping the bridge piece 2 with the thumb and index finger one can push or pull the bridge piece 2 up or down the tone bar's surface as needed. The bridge piece 2 is kept in its proper place or track and is kept in place on the tone bar 3 with the use of a bridge piece bolt 35 and nut 36. The bridge piece bolt 35 is inserted, free to turn, in a bridge piece hole 34 which exists from top to bottom through the bridge piece 2. The bridge piece bolt continues down through a groove 37 or T groove that is cut in to the top of the tone bar Again the bridge piece bolt is free to turn. The nut 36 which the bridge piece bolt 35 is secured to travels up and down the channel or the bottom section of the T-groove 37 cut in to the tone bar 3. This is illustrated in FIGS. 2(*b-g*). This nut 36 is tapped so that it will not easily come lose or separate from the bridge bolt 35. Once it has been determined where the bridge piece 2 needs to be positioned on the tone bar 3 to accomplish the correct height and intonation the bridge piece 2 is then secured to the tone bar 3 by a tightening of the bridge piece bolt 35 and nut 36. This eliminates any possibility of the bridge piece 2 moving out of position. At this time if the tension of the string required reducing prior to this positioning of the bridge piece 2 the string's tension can be returned to it's in tune tension level.

The bridge base plate 4 and full bridge assembly can be attached to the body of an instrument in several ways.

FIG. 5 shows a side elevational view illustrating a modern tremolo or fixed-bridge embodiment of a bridge system 20*a* in accordance with the invention. This embodiment utilizes a bridge piece 22 in place of a bridge piece 2 (FIG. 1). The bridge piece 2 design of FIG. 1, due to its smaller size, transfers the vibrations in a more direct and penetrating way producing a more focused sound. Also because of its small size it allows for a wider range of adjustment of its position for intonation. It also has the general appearance of many older, original or vintage bridge pieces.

The bridge pieces 22 of FIG. 5 have two functions. First they have a much larger and smoother surface. This is important for there are many musicians that, while playing their instrument, rest the palm of their plectrum hand on the bridge of the instrument. This bridge piece 22 provides a more comfortable surface on which to rest the palm. Secondly, the bridge piece 22 has a more smooth, or sleek, modern appearance. This embodiment may be used as a replacement bridge for all Fender modern style fixed bridges with or without a tremolo 30.

Figure 6A:
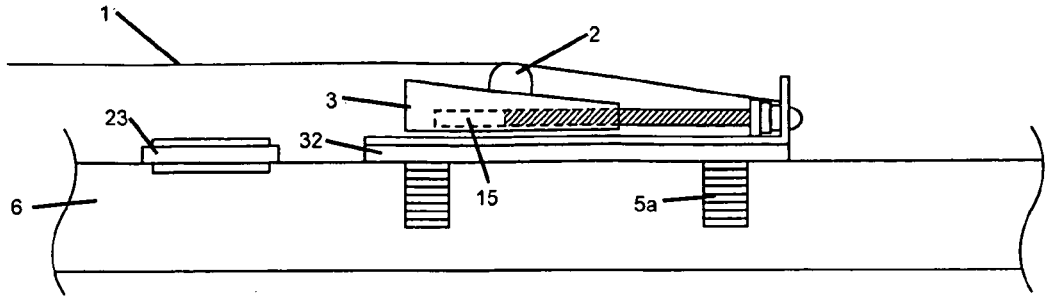
FIG. 6(*a*) shows a side elevational view illustrating a tune-o-matic style replacement bridge embodiment of a bridge system in accordance with the invention.
Figure 6B:
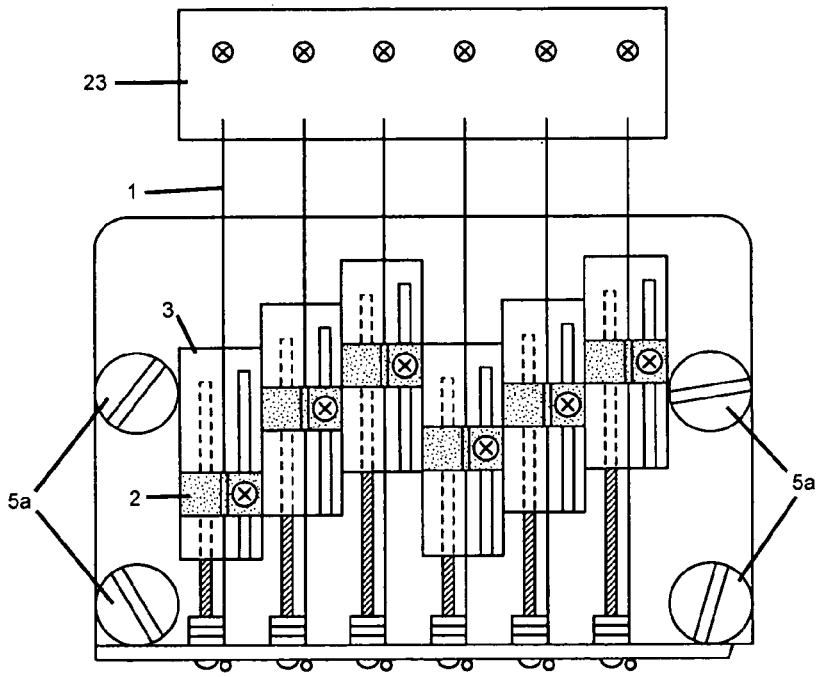

FIG. 6 shows a side elevational view illustrating a tune-o-matic style replacement bridge embodiment of a bridge system 20*b* in accordance with the invention. In accordance with this embodiment, bridge base plate 4 connects to bridge height adjustment bolts 5*a*. A spacer plate 32 may be provided between the body 6 of the instrument and the bridge base plate 4.

Figure 7:
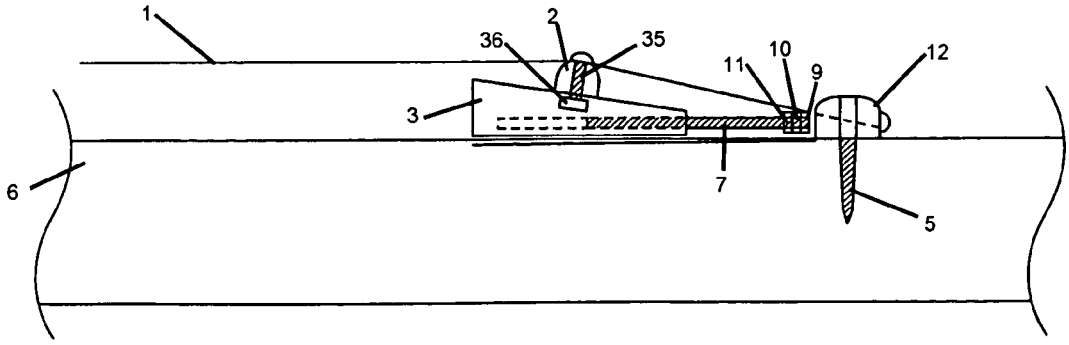
FIG. 7 shows a side elevational view illustrating an embodiment of the invention in which no bridge base plate is provided.
Figure 12A:
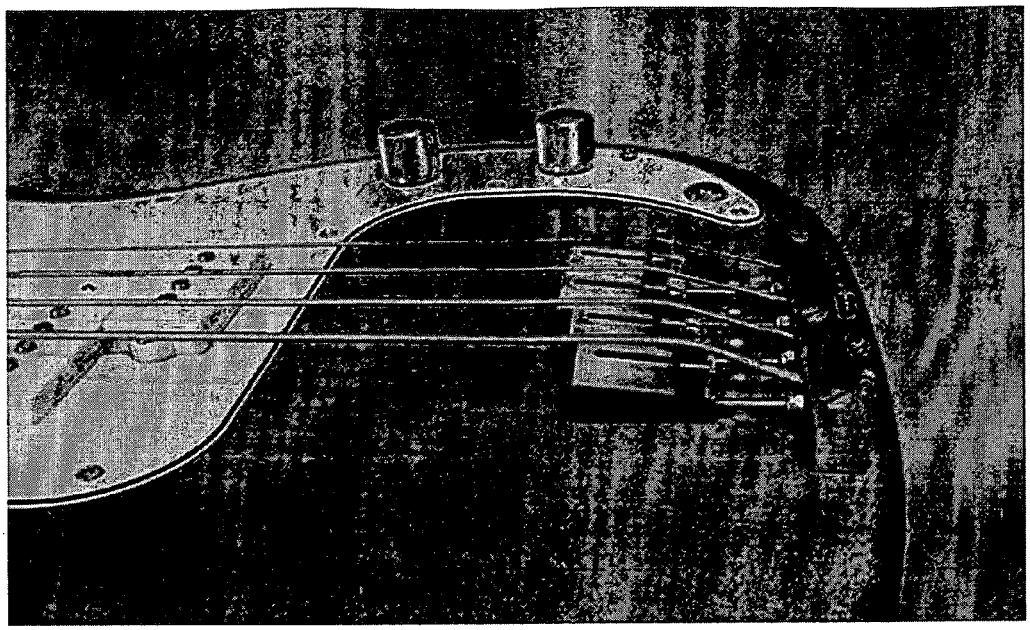
FIGS. 12(*a*)-(*f*) shows photographs of a prototype, in accordance with one embodiment thereof.
Figure 12B:
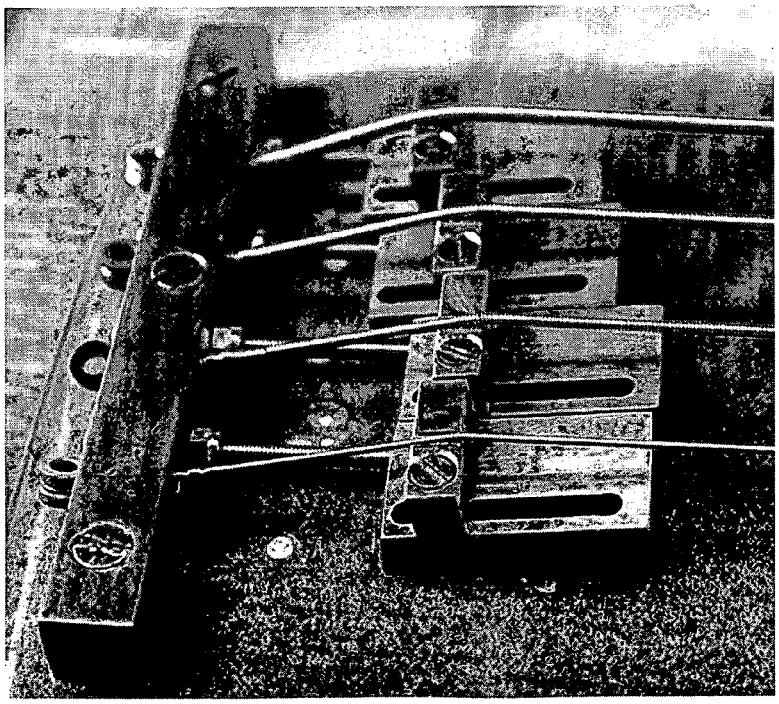
Figure 12C:
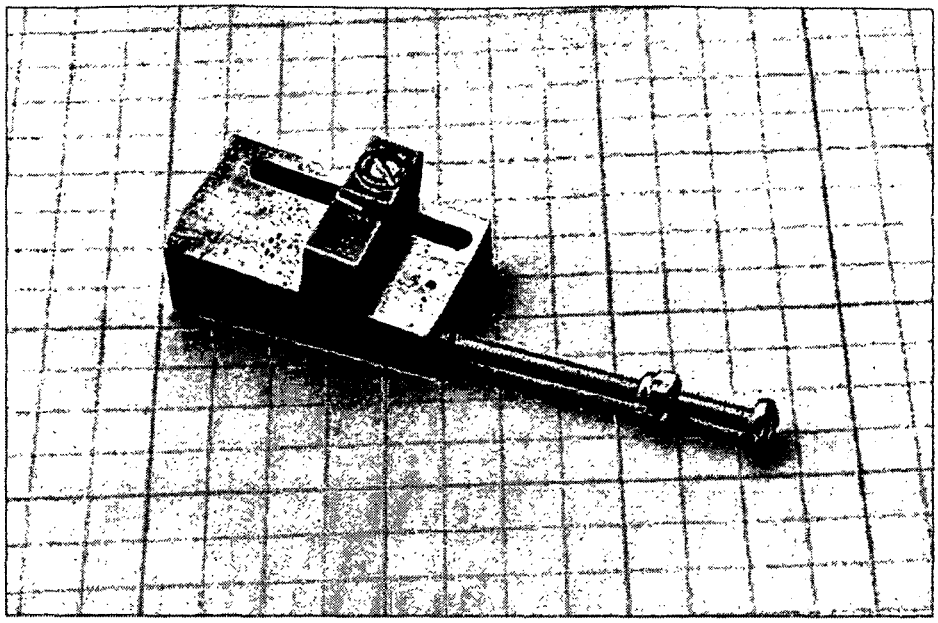
Figure 12D:
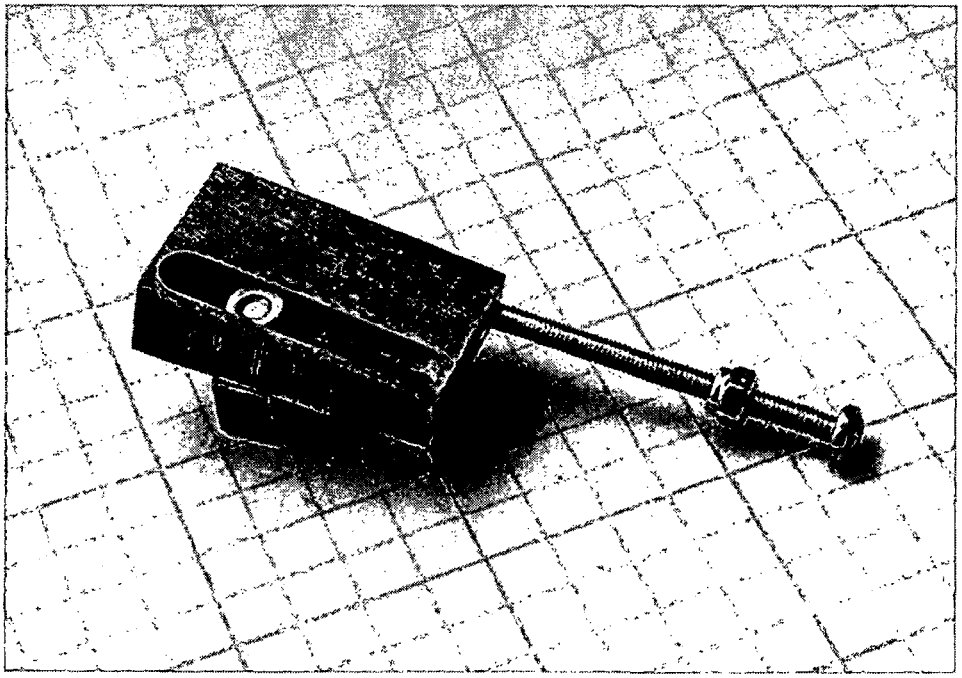
Figure 12E:
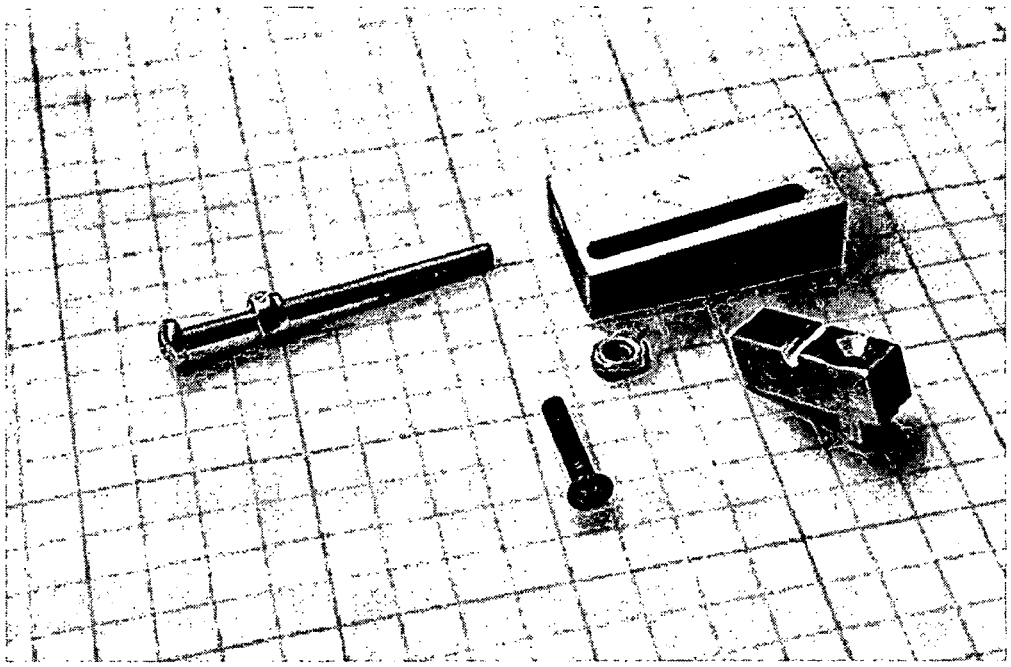
Figure 12F:
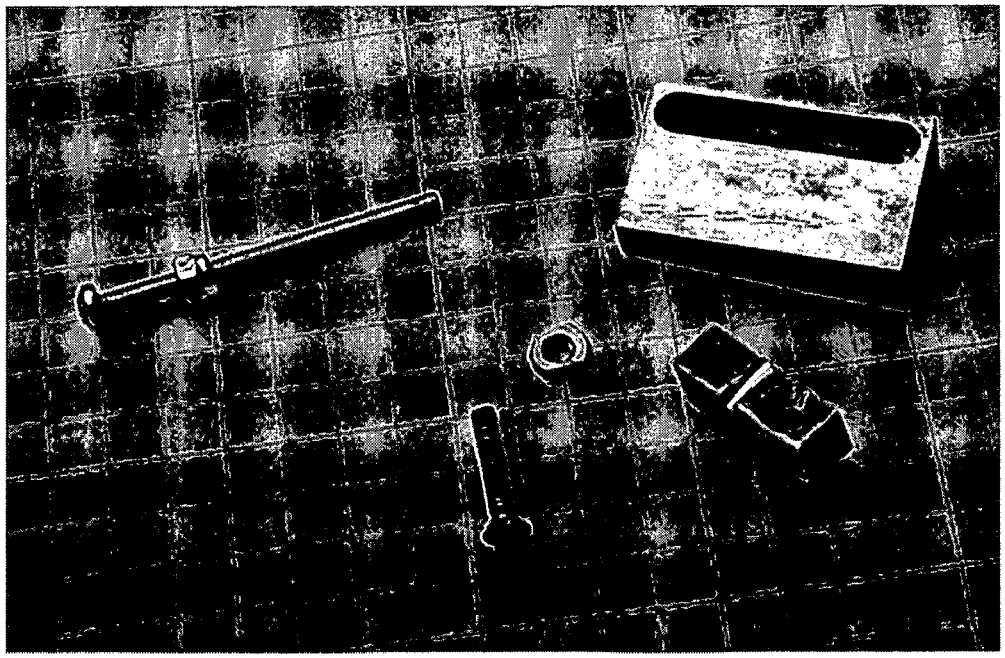

FIG. 7 shows a side elevational view illustrating an embodiment of the invention in which no bridge base plate is provided. In accordance with this embodiment, the height and tone adjustment bar(s) 3 rest directly upon the surface of the instrument body 6, thereby providing further improved indirect contact between the string 1 and the instrument body 6. This increases and intensifies the vibrations and tones produced by the bridge pieces and body of the instrument working in concert with each other.

In another embodiment, as illustrated in FIG. 8, the bridge system may consist of a bridge piece 2 or multiple bridge pieces 2 that the string 1 rests upon in a shallow slot 33 cut in the top of the bridge piece 2 at an approximate angle of 10 degrees. The downward angle's high point is at the top edge of the bridge piece 2 closest to the neck and the lower side of the slot 33 is on the opposite side of the bridge piece 2 that is closest to the anchor-piece 12 of the bridge assembly. This slot 33 has two important functions, one it keeps the string securely in place on the top surface of the bridge piece 2 and provides the downward angle necessary from the point where the string first comes in to contact with the bridge piece 2 to the opposite end of that bridge piece surface. This is necessary for the string 1 to vibrate clearly along its length from the point of contact of the bridge piece 2 and the point of contact at the "nut" located at the top of the neck of the instrument 6. If the string 1 were to sit on a flat surface, the string 1 would vibrate along its length that is sitting on the flat surface creating an unwanted buzzing or rattling sound.

The bridge piece 2 also has an u-shaped extended area on its bottom surface. This u-shaped extended area is precession made to fit in to a precision made slot cut in to the top of the height and tone adjustment bar 3. There is also a hole 34 drilled vertically down through the bridge piece 2 and through this u-shaped extended area of the bridge piece 2. This hole 34 is the same diameter and accepts the lock down bolt 35. The lock down bolt 35 is allowed to turn freely. The lock down bolt 35 passes through the bridge piece 2 in the hole 34 in the extended area. The lock down bolt 35 as it passes through the bottom of the bridge piece 2 extended area then enters the slot 37(*a*) cut in to the top of the height and tone adjustment bar 3. The end of the lock down bolt 35 can be seen through a slightly wider slot 37(*b*), which is in line with slot 37(*a*), that has been cut in to the bottom of the height and tone adjustment bar 3.

There is a lock down nut 36 that is threaded on to the lock down bolt 35. This bolt 35 may be rectangular in shape. Its width may be the same as the slot 37(*b*) cut in to the bottom of the height and tone adjustment bar 3. This lock down bolt 35, lock down bolt nut 36, and the bridge piece 2 with its extended area may be one unit and are allowed to move up and down the path of the two slots 37(*a*) and 37(*b*) allowing the bridge piece 2 to travel up and down the top surface of the height and tone adjustment bar 3. The lock down nut 36 cannot turn in the slot 37(*b*) at the bottom of the height and tone adjustment bar 3. After the lock down nut 36 has been threaded on to the lock down bolt 35, the end of the bolt 35 is "tapped" creating a locking situation that does not allow the bolt 35 to be separated from the nut 36. Once the positions of the bridge piece 2 and the height and tone adjustment bar 3 have been achieved, as described below, the lock down bolt 35 is turned to the right or tightened. The lock down nut 36 at the end of the bolt 35 cannot turn; so as the bolt 35 is turned, the nut 36 works its way up the bolt 35 until it comes to the top of the slot 37(*a*) cut in the height and tone adjustment bar 3. This bolt 35 is designed to be tightened firmly. Between the act of tightening the bolt 35 and the precision fit of the extended area of the bridge piece 2, the "lock down" operation creates a bond of the bridge piece 2 and the height and tone adjustment bar 3 which makes the two pieces become or act as one piece.

The height and tone adjustment bar 3 rests directly on the top surface of the body of the instrument 6. Generally, it is this surface piece on the top and its vibrating action that creates and is the source of the majority of sound and tone of an instrument 6. The bottom surface of the height and tone adjustment bar 3 is fitted or contoured to match perfectly the contour or shape of the surface of the instrument 6 that it rests upon. Generally, most string instruments' top surfaces are either flat or have some kind or arching radius. Either top can be matched in the making of the height and tone adjustment bar 3 creating a situation where both surfaces are in full contact where they come together. On the top side of the height and tone adjustment bar 3, the surface is smooth and flat but has a slope. This slope is higher at the end of the height and tone adjustment bar 3 closest to the fretboard of the instrument 6 and lower at the end of the height and tone adjustment bar 3 that is nearest the anchor-piece 12 of the bridge assembly.

As described above, there is a slot 37(*a*) in the top of the height and tone adjustment bar 3 and another slot 37(*b*) in the bottom of the height and tone adjustment bar 3 that line up with one another to allow for the extended area of the bridge piece 2, the lock down bolt 35 and nut 36 to fit through. As also stated above, the bridge piece 2 rests on top of the height and tone adjustment bar 3 and can be moved up and down or along its top surface until "locked down." At the lower end of the height and tone adjustment bar 3, facing the anchor piece 12, is a threaded hole 15. This hole 15 accepts the height and tone adjustment bolt 7, which has matching threads.

The height and tone adjustment bolt 7 is placed in a horizontal hole in the anchor-piece 12. The head of the bolt 7 is positioned on the outside surface of the anchor-piece 12 on the side furthest from the height and tone adjustment bar 3, bridge pieces 2, and fretboard of the instrument 6. The height and tone adjustment bolt 7 is then threaded into the matching threaded hole 15 of the height and tone adjustment bar 3. There is a locking nut 9 on the height and tone adjustment bolt 7 located on the opposite side of the anchor-piece 12 from the head of the height and tone adjustment bolt 7. This bolt 7 would be described as being between the anchor-piece 12 and the height and tone adjustment bar 3. This bolt 7 is not tightened up against the anchor-piece 12. Its position is adjusted so that the bolt 7 can turn freely, but close enough to the anchor-piece 12 to not allow any unwanted horizontal movement of the bolt 7 and the height and tone adjustment bar 3 of which it is connected or screwed in to.

The anchor-piece 12 has horizontal holes bored through its width from back to front. One set of holes is for the corresponding number of height and tone adjustment bar 3 and adjustment bolts 7 that are required to accommodate the set number of strings 1. The other set of horizontal holes are also bored through its width, from back to front, in order to accommodate the strings 1. The strings 1 are fed through the holes and are stopped by a ball attached at the end of the string 1. These ball-ends rest upon the side of the anchor-piece 12 furthest from the height and tone adjustment bar 3.

There are two adjustment operations every string instrument must have for proper operation, one is the string height and the other is adjusting the bridge position for the correct intonation setting. The two simple actions are performed simultaneously in the adjustment or set-up of both settings. The instrument is placed lying flat with its back side on a bench or table, the strings and bridge assembly facing upwards, as in FIG. 1. The neck is to the technicians left and the body to the right. The lock down bolt 35 on the bridge piece 2 is loose at this time allowing the bridge piece 2 to be moved freely along or up and down the top surface of the height and tone adjustment bar 3. The bridge piece 2 will stay on track for part of the bridge piece 2 is u-shaped and extends down in to the slot 37(*a*) cut in to the height and tone adjustment bar 3. With the right hand, a screw driver is used to turn the adjustment bolt 7 in the direction required to move the height and tone adjustment bar 3 to its desired position.

A turn of the bolt 7 to the left will move the height and tone adjustment bar 3 to the left or towards the fretboard. A turn of the bolt 7 to the right will move the height and tone adjustment bar 3 to the right or towards the end of the body of the instrument 6. This turning of the adjustment bolt 7 only moves the height and tone adjustment bar 3 because of the head of the height adjustment bolt 7 is located on the outside of the anchor-piece 12 and a lock nut 9 is positioned and treaded on to the adjustment bolt 7 and is located on the opposite or inside of the anchor-piece 12. Meanwhile with the thumb and index finger of the left hand, movement of the bridge piece 2 along the top surface of the height and tone adjustment bar 3 is performed. The technician moves the two pieces until their positions achieve both the height desired and the position of the bridge piece 2 for proper intonation. Once this is complete, the lock down bolt 35 is turned to the right until tight. This action locks the bridge piece 2 and the height and tone adjustment bar 3 tightly together. The two pieces now act as one piece.

The presently disclosed bridge system provides the most direct and fullest contact of the string 1 to the body of any string instrument 6 through a single object. After adjustments have been made and the bridge piece 2 and height and tone adjustment bar 3 have been locked together with the use of the lock down bolt 35. This bridge system sits directly on the top surface of the body of the instrument 6. In the disclosed embodiment, the bridge system is only one piece or one object connecting the string 1 to the body of the instrument 6; thus being extremely efficient and accurate in the vibration transfer process. Other designs for bridges have multiple pieces or objects between the string and body of the instrument. Those other bridge designs have an adjustment screw or bolt in the design further limiting the transfer of vibrations from string to body of the instrument by depending on the vibrations to travel through the usually very small in diameter screw or bolt. In the presently disclosed design, there are no vertical adjustment bolts used in the vertical movement necessary to achieve string height adjustments.

The disclosed system offers a simple way to make adjustments for the purpose of achieving a highly accurate setting of both string height and string intonation. By simply turning the adjustment bolt 7, and at the same time sliding the bridge piece 2 in to the desired position, both string height and intonation are achieved simultaneously.

Due to the full contact of the bridge system to the top of the body of the instrument 6, an unprecedented sustaining of the string vibrations or notes occurs. The bridge pieces 2 are individual pieces, as opposed to an one-piece design. This allow for better and more accurate adjustments for each string 1. The present disclosure can be adapted for any number of strings 1. In addition, the bridge system may be adapted for use on, but not limited to, both solid body and hollow body string instruments, whether they be either acoustic or electric instruments. Furthermore, the bridge system may be adapted without changing the basic principle or equipment which is part of the original design that provides the full and direct contact of the string to the body of the instrument 6. Embodiments not employing any traditional bridge body shell in their construction have an unique and new design. Ultimately, the combination of all the above features provides the musician with the most "feel" and feedback information crucial in the interpretation of music and the expression of emotions through the sounds generated while play an instrument with this equipment.

In the case of string instruments with hollow bodies, an optional u-shaped or v-shaped rod assembly may be used to secure the bridge system to the side of the body of a hollow body string instrument 6. FIGS. 11(*a*)-(*b*) illustrates such a rod 16 with threaded ends that accept two locking nuts 17 on each end of the rod 16. The rod 16 at its midpoint runs through a clamp 18. The clamp 18 is attached to the body of the instrument 6 with the use of a clamp screw 19 that is fed through a hole in the clamp 18 and screwed into the body of the instrument 6. Also shown is the rod 16 fed through the anchor-piece 12 with lock nuts 17 on either side of the anchor-piece 12. As seen in FIG. 11(*c*), the rod 16 may be bent at a 90 degree angle at its midpoint. The lock nuts 17 on either side of the anchor-piece 12 and the position of the clamp 18 and the clamp screw 19.

The disclosed bridge system may include of an anchor-piece 12 which is attached to the body of the instrument 6 by use of anchor-piece screws 5 anchored or screwed down into the solid body of the instrument 6. In the application of using this disclosed bridge system with instruments that have a hollow chamber body, the usually thin top material of the instrument body 6 would not securely hold the anchor-piece screws 5 due to pull of the strings 1 under tension. There has to be solid material on the side of the instrument 6 at its bottom bout. Such a solid piece will make for a good place to attach the bridge system securely. In this application of the bridge system, the anchor-piece 12 will be modified with two holes drilled horizontally through the anchor-piece one at each end. As explained above, a u-shaped or v-shaped rod 16, with both of its ends threaded to accept the installation of a locking nut 17, is positioned on both sides of the anchor-piece 12. The u-shaped or v-shaped rod 16 would be fed through the holes in the anchor-piece 12. The u-shaped or v-shaped rod 16 would have two of the locking nuts 17 already installed down the rod 16 approximately the same measurement of the width of the anchor-piece 12 plus double the width of the locking nut 17. After the rod 16 is inserted in the two holes in the anchor piece 12, the other two locking nuts 17 would be threaded onto the rod 16 until tight. The locking features of the locking nuts 17 will aid in the stabilization of the entire bridge system. The rod 16 at its midpoint contains an attached clamp 18. Also, the rod 16 may be bent at a 90 degree angle at its midpoint to accommodate being attached to the side of the body of the instrument 6.

This clamp 18 is attached and secured to the body of the instrument 6 with the use of a clamp screw 19 to allow full contact between the body of the instrument 6 and the surface of a bridge piece 2. This bridge piece 2 does not employ the usual bridge body or shell for the purpose of supporting or adjusting the bridge pieces. This bridge piece sits directly on the height and tone adjustment bar 3. Once these two pieces have been adjusted in to the proper position to achieve both proper string height and proper position for correct intonation, the two parts are bolted together by the lock down bolt and nut. This action then makes these two objects act as one. Because the height and tone adjustment bar 3 and bridge piece 2 sits directly on the surface of the body of the instrument 6, making direct and full contact with the instrument body, vibrations transfer from the string 1 to the body 6, which transfer the full tone colors, and allow for feedback and "feel" are achieved to the maximum, even in the case of string instruments with hollow bodies.

An embodiment of the presently disclosed bridge system is represented in the photographs depicted in FIGS. 12(*a*)-(*f*).

The invention described in exemplary embodiments above provides a bridge system that is capable of providing improved sustain, increased tonal possibilities, and more full contact between the string, the bridge piece, the bridge plate, and ultimately the instrument's body. The bridge system provides a more solid feeling in the string for the musician in comparison to other designs, and more feedback from the guitar body to the musician. The bridge system of the present design can further provide more range available for setting intonation. The present bridge system can provide the ability to adjust, raise and lower strings smoothly and easily, and a means to raise and lower string height while maintaining a full, solid contact from string to bridge to body of the instrument. The bridge system in certain embodiments eliminates the old bridge height adjustment feet and height adjustment studs which cause sound to be lost. The invention eliminates many rattles and sympathetic vibrations that exist in other designs. The disclosed system provides the ability to change the materials from which the height adjustment bars and bridge pieces are constructed, giving the musician different tones and sustaining combinations to choose from. The bridge system of the invention can be designed to replace current and legacy bridges by using their existing means of attaching the bridge to the body, with little or no drilling of new holes.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A bridge system for connection to the instrument body of a stringed instrument, comprising:

at least one bridge piece configured to contact at least one string of the stringed instrument;

a ramp-shaped height and tone adjustment bar between the bridge piece and the instrument body; and, a bridge adjustment mechanism that translates the bridge piece with respect to the height and tone adjustment bar to raise and lower the string and to provide contact between the bridge piece and the height and tone adjustment bar;

wherein the bridge adjustment mechanism comprises a bridge bolt, the bridge bolt connected to the bridge piece, a bridge nut mounted to one end of the bridge bolt, the bridge nut slideably mounted within a groove in the height and tone adjustment bar for translating the bridge piece.

2. The bridge system in accordance with claim 1, further comprising a bridge base plate between the height and tone adjustment bar and the instrument body.

3. The bridge system in accordance with claim 1, wherein the bridge piece is movably and securely mounted to the height and tone adjustment bar for translating the bridge piece with respect to the height and tone adjustment bar.

4. The bridge system in accordance with claim 1, wherein the height and tone adjustment bar is constructed of metal.

5. The bridge system in accordance with claim 1, wherein the height and tone adjustment bar is constructed of brass.

6. The bridge system in accordance with claim 1, wherein the height and tone adjustment bar is constructed of lead.

7. The bridge system in accordance with claim 1, wherein the height and tone adjustment bar is constructed of copper.

8. The bridge system in accordance with claim 1, wherein the height and tone adjustment bar is constructed of graphite.

9. The bridge system in accordance with claim 1, wherein the height and tone adjustment bar is constructed of solid surface material.

10. The bridge system in accordance with claim 1, wherein the height and tone adjustment bar is constructed of thermosetting plastic.

11. The bridge system in accordance with claim 1, wherein the height and tone adjustment bar is constructed of animal bone.

12. The bridge system in accordance with claim 1, wherein the height and tone adjustment bar is constructed of wood.

13. The bridge system in accordance with claim 1, wherein the height and tone adjustment bar is constructed of a polymer.

* * * * *